United States Patent [19]

Wright et al.

[11] 3,943,596

[45] Mar. 16, 1976

[54] CLEANING OF TEXTILE CARDING MACHINES

[75] Inventors: Thomas Henry Wright, Bury; Robert Lane, Accrington, both of England

[73] Assignee: Platt International Limited, England

[22] Filed: July 24, 1974

[21] Appl. No.: 491,952

[30] Foreign Application Priority Data

July 25, 1973 United Kingdom ..... 35444/73

[52] U.S. Cl. ..... 15/301; 15/345; 19/107

[51] Int. Cl.[2] ..... A47L 5/38; D01G 15/76

[58] Field of Search..... 15/301, 316 R, 345, 346, 15/405; 19/107

[56] References Cited

UNITED STATES PATENTS 3,150,415 9/1964 Reiterer ..... 15/301 X

FOREIGN PATENTS OR APPLICATIONS 1,085,119 9/1967 United Kingdom ..... 19/107

*Primary Examiner*—Stanley N. Gilreath
*Assistant Examiner*—C. K. Moore
*Attorney, Agent, or Firm*—Watson, Cole, Grindle & Watson

[57] ABSTRACT

In the removal of trash and waste from beneath a carding machine the trash and waste is collected on support means positioned beneath the carding elements of the machine and a flow of air is created in a direction to transport the trash and waste on the support means to a waste collection zone by supplying pressurized air to a plurality of spaced nozzles arranged above the support means in such a manner that each of a plurality of preselected groups of rows of said nozzles is supplied with the pressurized air in turn and cyclically.

16 Claims, 6 Drawing Figures

CLEANING OF TEXTILE CARDING MACHINES

Figure 1:
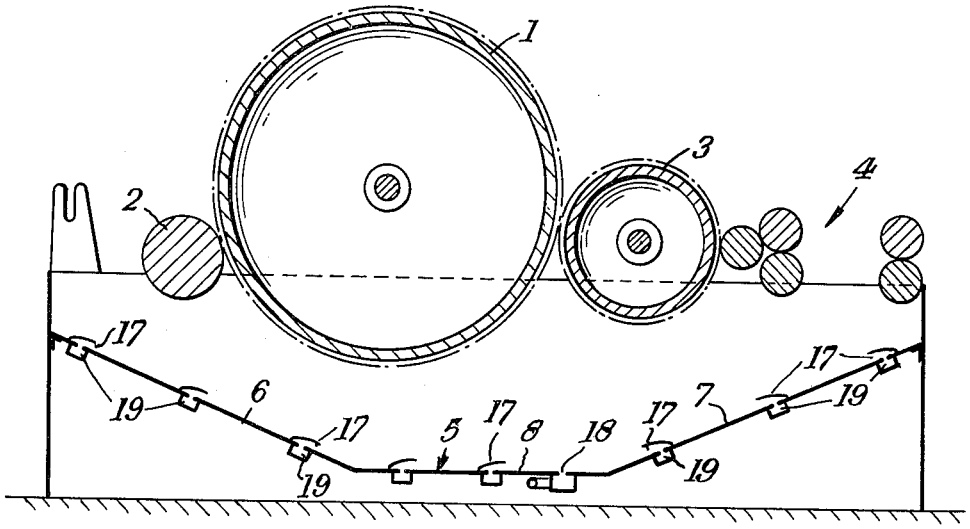

The present invention relates to the cleaning of a textile carding machine and is particularly concerned with the removal of trash and waste which is liberated from the carding elements of the machine, namely the taker-in, the cylinder and the doffer and which accumulates beneath the card.

The carding of cotton is known to give rise to the liberation of considerable quantities of trash and cotton waste, which collect on the underside of the machine and it has been a long outstanding problem to provide an efficient and economical pneumatic waste removal apparatus which is able to remove trash and waste in all its different forms with only a small energy requirement.

Clearly, where no limitation is put on energy consumption, then a continuous air blast introduced beneath the card at one end thereof and withdrawn from the other end could be made of sufficient intensity to provide effective clearing of trash and waste. The air intensity, however, needs to be large and this gives rise to differential pressures at the carding elements which adversely affect the carding operation. On the other hand, reduction in intensity gives rise to an incomplete cleaning operation.

According to one aspect of the present invention, there is a textile carding machine including pneumatic waste removal apparatus for removing trash and waste from beneath the carding machine, said apparatus comprising:

air supply means for supplying pressurized air; trash and waste support means positioned beneath the carding elements of the machine and on which trash and waste are deposited;

a waste collection zone;

a plurality of nozzles arranged in spaced relation above the support means for emission of blasts of air from said air supply means to create a flow of air over said support means to transport trash and waste entrained thereby to said waste collection zone; and an air supply distribution means to distribute said supply of pressurised air in turn and cyclicly to each of a plurality of predetermined ones or sets of said nozzles.

According to a second aspect of the present invention, there is provided a method of pneumatically removing trash and waste from beneath a carding machine comprising the steps of collecting the trash and waste on support means positioned beneath the carding elements of the carding machine and creating a flow of air in a direction to transport the trash and waste on said support means and entrained thereby to a waste collection zone by supplying pressurized air to a plurality of spaced nozzles arranged above the support means in such a manner that each of a plurality of preselected groups of rows of said nozzles is supplied with the pressurized air in turn and cyclically.

Preferably, the nozzles are arranged to project from a support plate passing beneath the carding elements of the machine and are arranged in a plurality of rows extending across the width of the card at spaced intervals along the support plate from the front to the rear of the carding machine, that is to say, from the doffer region of the machine to the taker-in region. Each row contains a predetermined plurality of nozzles, the number of the nozzles and sizes of the orifices thereof being dependent upon the air velocity which it is desired to create in that region of the support plate and upon the amount of pressurized air available. The supply of air may be so controlled by the said air supply distribution means that the air velocity generated at each row of nozzles is the same as that generated at each of the other rows of nozzles. On the other hand, the distribution means may be made such as to provide for different air supplies for the different rows of nozzles so that a greater air velocity is obtained from one row of nozzles than that obtained from another row of nozzles. In particular, the air velocity requirements in the doffer region of the card are usually regarded as being less than those in the region of the taker-in and in one embodiment of the invention the pressurized air supply to a row of nozzles in the taker-in region is made substantially greater than the supply to a row of nozzles in the taker-in region.

Figure 2:
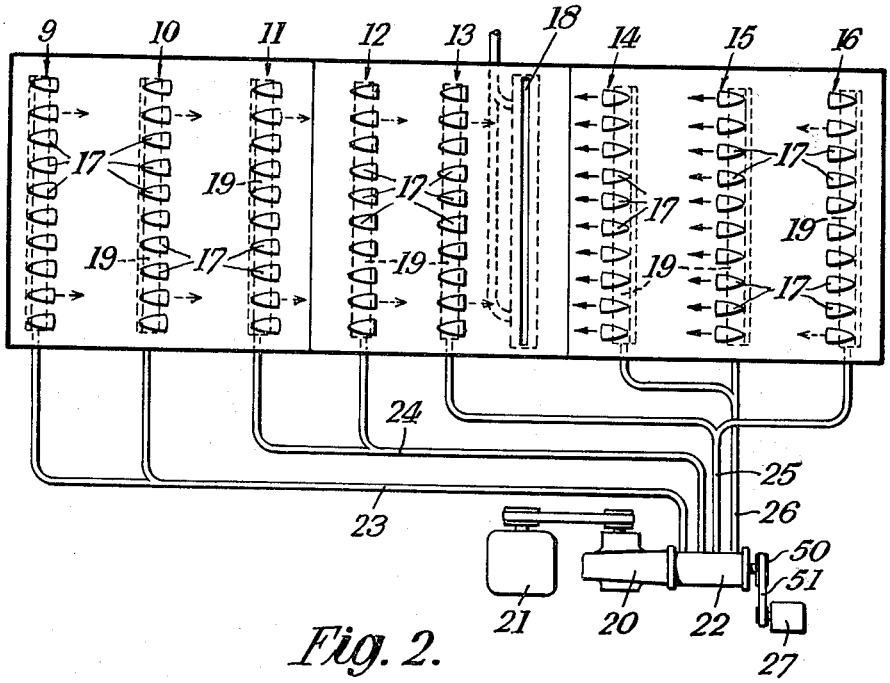
Figure 3:
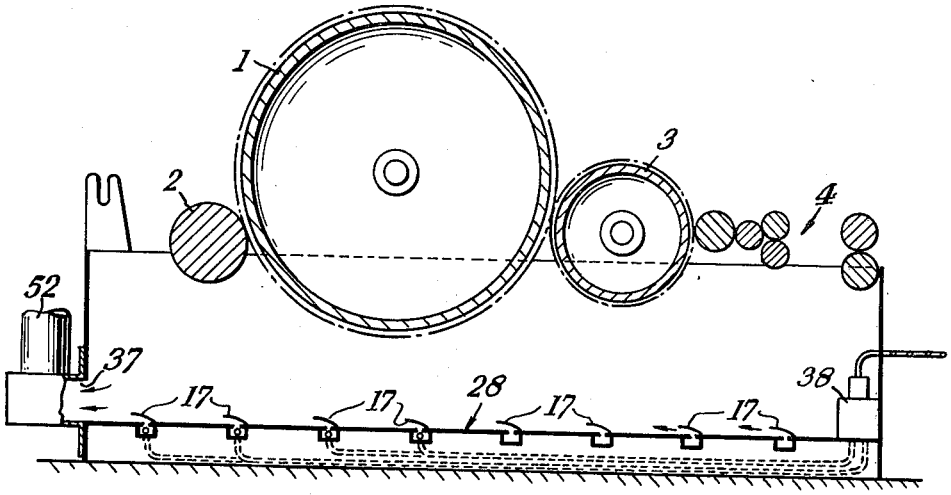
Figure 4:
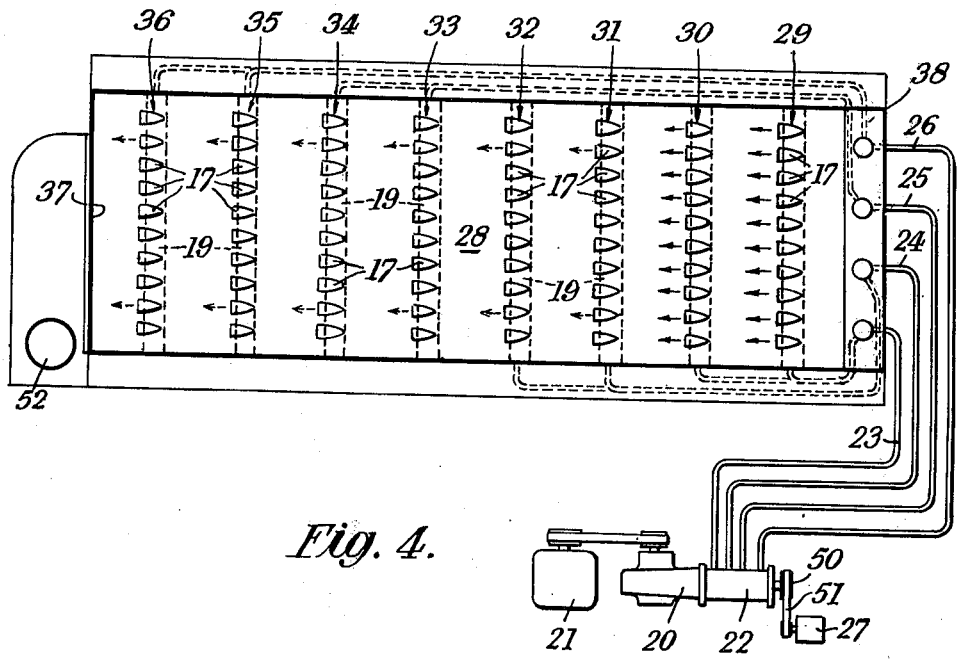
Figure 5:
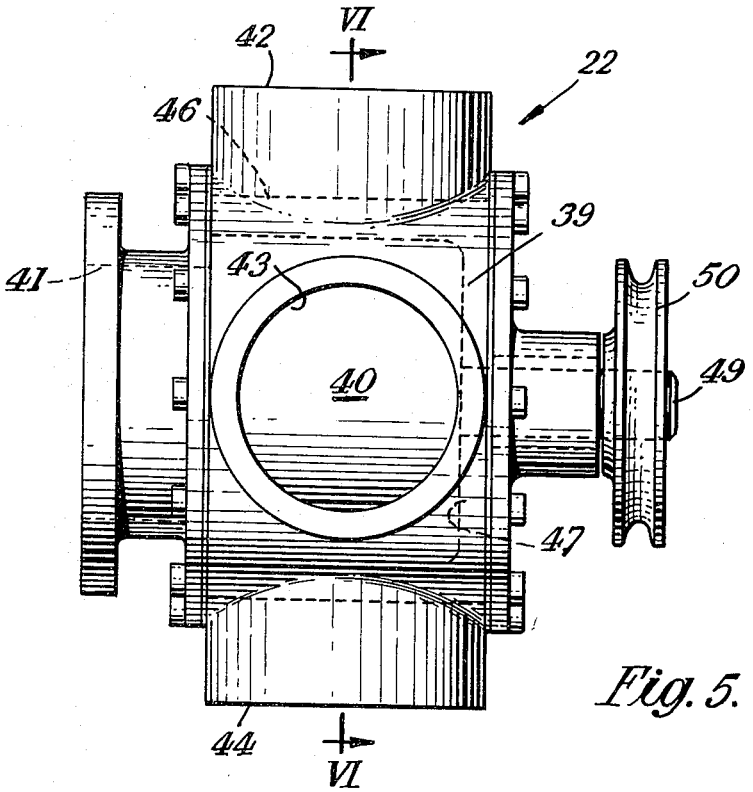

Two embodiments of the invention will now be described by way of example with reference to the accompanying drawings, in which:

FIG. 1 is a schematic section of a cotton carding machine in accordance with the first embodiment of the invention, FIG. 2 is a plan of the machine shown in FIG. 1, with some parts removed for clarity, FIG. 3 is a schematic section of a cotton carding machine in accordance with a second embodiment of the invention, FIG. 4 is a plan of the machine shown in FIG. 3, with some parts removed for clarity, FIG. 5 is a plan view of a rotary valve for use in the machine illustrated in FIGS. 1 and 2 or 3 and 4, and FIG. 6 is a section of the valve shown in FIG. 5, taken on the line VI — VI in FIG. 5.

In FIGS. 1 and 2 numeral 1 represents the main cylinder of a cotton carding machine having associated taker-in and doffer cylinders 2 and 3 respectively and web and sliver forming elements generally designated 4. Beneath these elements is mounted a waste collection plate 5 forming part of a waste removal apparatus The plate 5 has two sections 6 and 7 inclined downwardly toward an intermediate horizontal section 8. The plate 5 is formed with eight rows 9, 10, 11, 12, 13, 14, 15 and 16 of nozzles 17 which project from the upper side of the plate 5. A waste suction slot 18 is formed in the horizontal section 8 of the plate 5 which, in use, is connected to a source of suction and provides a waste extraction zone.

Each nozzle 17 in the row 9 is in communication with an air duct 19 common to all the nozzles of the row and extending transversely across the plate 5. The exit of each nozzle faces towards the suction slot 18. The nozzles 17 of the rows 10, 11, 12, 13, 14, 15, and 16 are connected in like manner to air ducts 19.

Pressurized air is supplied to the ducts 19 by a fan 20 driven by an electric motor 21, the pressurized air delivered by the fan passing to a rotary control valve 22 having four outlets to which are connected tubes 23, 24, 25 and 26. Tube 23 provides a connection to air ducts 19 of rows 9 and 10; tube 24 provides a connection to air ducts 19 of rows 11 and 12; tube 25 provides a connection to air ducts 19 of rows 13 and 16; and tube 26 provides a connection to air ducts 19 of rows 14 and 15. The rotary valve 22 is operated continuously by a low speed electric motor 27 and provides for the connection in turn of the pressurised air supply from the fan 20 to each of the tubes 23, 24, 25 and 26.

In operation, trash and cotton waste ejected from the machine elements 1, 2, 3, and 4 collect on the plate 5. On actuation of the rotary valve 22 by means of the low speed electric motor 27 an outlet from the valve causes pressurized air to pass through tube 23 and thus into both of the ducts 19 associated with rows 9 and 10 such that a blast of air is emitted from the nozzles 17 in the direction indicated by the arrows. Further rotation of the valve member of rotary valve 22 begins to close the valve outlet to tube 23 and begins to open the next valve outlet associated with tube 24 so that pressurized air is directed to air ducts 19 associated with rows 11 and 12. Continued rotation of the valve member of rotary valve 22 begins to close the valve outlet to tube 24 and begins to open the valve outlet connected with tube 25 which allows the pressurized air to flow to air ducts 19 associated with rows 13 and 16. Finally, as the valve outlet connected to tube 25 is closed the valve outlet associated with tube 26 begins to open to allow air to flow to air ducts 19 associated with rows 14 and 15 and to be emitted by the nozzles 17. The cycle is then repeated.

Thus trash particles and cotton waste are advanced by the blasts of air from the nozzles 17 towards the waste extraction zone where the continuously operating suction of another pneumatic system withdraws the material through suction slot 18 into a duct for transmission to a central waste room.

Referring next to FIGS. 3 and 4, a further embodiment of the invention is illustrated. In this embodiment the waste collection plate is constituted by a horizontally disposed plate 28 formed with eight rows 29, 30, 31, 32, 33, 34, 35 and 36 of nozzles 17 which project from the upper side of the plate 28.

As in the embodiment illustrated in FIGS. 1 and 2 each nozzle 17 in the row 29 is in communication with an air duct 19 and each of the nozzles 17 in each of the other rows 29 – 36 is likewise in communication with an air duct 19. In the embodiment illustrated in FIGS. 3 and 4, however, each nozzle faces in the same direction toward the waste extraction zone constituted by a suction slot 37, extending transversely of the carding machine and formed in an end surface thereof. The slot 37 is connected to a source of suction.

The tubes 23, 24, 25, and 26 associated with the four outlets on the rotary valve 22 are connected via a tube locator 38 to the air ducts 19. The tube 23 provides a connection between the rotary valve 22 and air ducts 19 of rows 29 and 30, tube 24 with air ducts 19 associated with rows 31 and 32, tube 25 with air ducts 19 associated with rows 33 and 34 and tube 26 with air ducts 19 associated with rows 35 and 36.

In operation, the low speed electric motor 27 causes rotation of the valve member of rotary valve 22 so that a valve outlet causes pressurised air to pass through tube 23 and thus into both of the ducts 19 associated with rows 29 and 30. Continued actuation of rotary valve 22 successively causes the tubes 24, 25 and 26 to be connected to the fan 20 so that rows 31 and 32, then rows 33 and 34 and finally rows 35 and 36 are successively connected to the pressurised air. Thus the air emitted from the nozzles 17 progressively transports the trash particles and cotton waste towards the waste extraction zone where it is continuously removed through the suction slot 37 into a duct 52 for transmission to a central waste room.

The embodiment illustrated in FIGS. 3 and 4 may if desired be modified by arranging that the plate 28 slopes downwardly towards the waste extraction zone.

Each of the nozzles 17 may conveniently be formed simply by drilling a hole through the plate 5 or 28 at the nozzle position and placing over the hole a nose-piece of streamline configuration and provided with an opening such that air blow therethrough transports trash along the plate.

The rotary valve is preferably so designed that the valve member begins to open the next succeeding valve outlet before the preceding outlet is closed. This gives a more continuous mode of operation. However, it is also possible so to design the valve that a valve outlet is completely closed before the next succeeding outlet begins to be opened.

The embodiments have been described with reference to a rotary valve having four outlets but it will be appreciated that the valve may have as many outlets as there are rows of nozzles. Thus each row of nozzles may be individually connected to the pressurized air producing fan.

Preferably, the nozzle orifices are of uniform size and the supply of air may be so controlled that the air velocity at each row of nozzlels is the same as that generated at each of the other rows of nozzles. However the arrangement may be such as to provide for different air supplies for different rows of nozzles so that a greater air velocity is obtained from one row of nozzles than that obtained from another row of nozzles. In particular, the pressurised air supply to the row or rows of nozzles in the region of the waste extraction zone can be made greater than the supply to the row of nozzles remote from the waste extraction zone.

Figure 6:
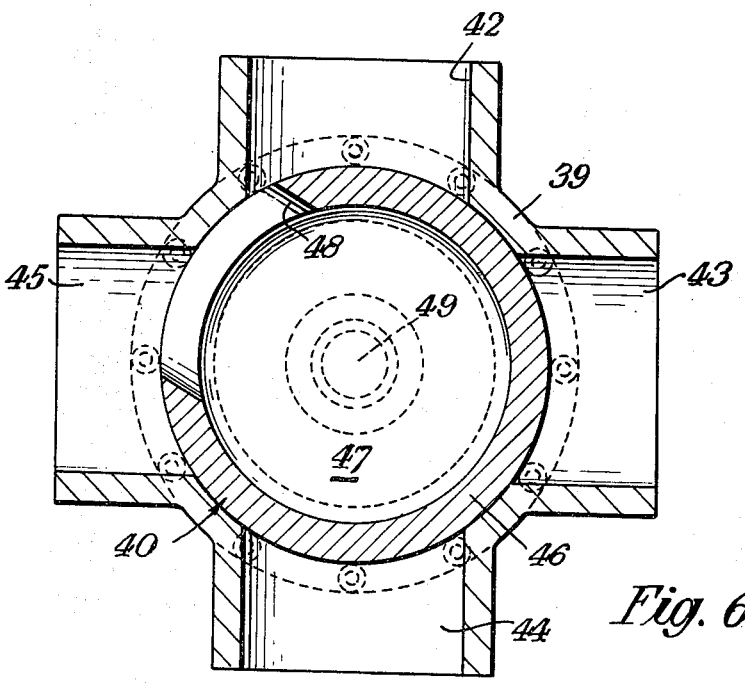

The rotary valve 22 may take the form illustrated in FIGS. 5 and 6. The valve comprises a valve body 39 and a rotary member 40. The body 39 has an inlet port 41 for connection to a source of pressurized air, i.e., the fan 20, and four outlet ports 42, 43, 44 and 45 which extend radially outwardly from the valve body 39 for connection to the pressurized air supply tubes 23, 24, 25 and 26. The rotary member 40 is open at one end adjacent the inlet port 41 and has a cylindrical side wall 46 connected to an end portion 47 which closes the other end. An aperture 48 is formed in the side wall 46. Connected to the end portion 47 is a driving shaft 49 on which is fixedly attached the driving pulley 50. As seen in FIGS. 2 and 4, the pulley 50 is connected by a belt 51 to the low speed electric motor 27 which, in operation, serves to rotate the rotary member 40. Thus, as rotary member 40 rotates, each of the valve outlet ports 42 to 45 is successively in communication with the inlet port 41 thereby causing pressurised air to flow into tubes 23, 24, 25 and 26 in turn.

The aperture 48 is such that it begins to open the next succeeding outlet port before closing the preceding outlet port in order to provide a continuous supply of pressurized air to the system.

What we claim as our invention and desire to secure by Letters Patent is:

1. A textile carding machine including pneumatic waste removal apparatus for removing trash and waste from beneath the carding machine, said apparatus comprising:

air supply means for supplying pressurized air;

trash and waste support means positioned beneath the carding elements of the machine and on which trash and waste are deposited;

a waste collection zone;

a plurality of nozzles arranged in spaced relation above the support means for emission of blasts of air from said air supply means to create a flow of air over said support means to transport trash and waste entrained thereby to said waste collection zone;

said nozzles being further arranged in a plurality of rows containing at least one nozzle each; and an air supply distribution means to contribute said supply of pressurized air in turn and cyclicly to each of a plurality of preselected groups of said rows of said nozzles, said groups each consisting of at least one row of nozzles.

2. Apparatus according to claim 1 wherein said plurality of rows extend across the width of the carding machine at spaced intervals from the front to the rear of the carding machine.

3. A machine according to claim 2, wherein the number of nozzles, the sizes of the orifices thereof, and the supply of pressurized air thereto are such as to provide a predetermined air velocity vector pattern over the support means.

4. A machine according to claim 3 wherein the number of nozzles and the sizes of the orifices thereof and the supply thereto of pressurised air from said air supply distribution means are such that the velocity of the air produced at each row of nozzles is the same as that generated at each of the other rows of nozzles.

5. A machine according to claim 3, wherein the number of nozzles in each row and the sizes of the orifices thereof and the supply of pressurized air thereto from said air supply distribution means is such that the air obtained from one row of nozzles issues at a greater velocity than that at which the air issues from another row of nozzles.

6. A machine according to claim 5, wherein the velocity of the air issuing from the nozzles beneath the taker-in region of the machine is greater than that issuing from the nozzles in the doffer region of the machine.

7. A machine according to claim 6, wherein the said air supply distribution means is such as to supply pressurized air to nozzles beneath the taker-in region at a rate less than that of the air supply nozzles beneath the doffer region.

8. A machine according to claim 1, wherein said trash and waste support means comprises a support plate passing beneath the carding elements of the machine and wherein said nozzles are arranged to project from said support plate.

9. A machine according to claim 8, wherein the support plate includes at least two sections; one of which lies in the taker-in region and extends downwardly and forwardly in said region, and the other of which lies in the doffer region and extends downwardly and rearwardly in the doffer region.

10. A machine according to claim 9, wherein the said support plate includes an intermediate section between said first and second sections, wherein said intermediate section is arranged horizontally beneath the main cylinder of the carding machine.

11. A machine according to claim 9, wherein the said waste collection zone is arranged between the said first and second sections of the support plate and wherein the said nozzles provided in said sections are so disposed as to direct air issuing therefrom in opposite directions toward the said waste collection zone.

12. A machine according to claim 11, wherein the said collection zone is formed by a slot in the intermediate section of the support plate, said slot extending across the width of the machine in a region beneath the nip between the main cylinder and the doffer of the machine.

13. A machine according to claim 8, wherein the said support plate is arranged horizontally beneath the machine and is provided with nozzles so disposed as to direct air therefrom over the support plate from the doffer region of the machine to the taker-in region of the machine, and wherein the said waste collection zone is situated at the taker-in region of the machine.

14. A machine according to claim 1, wherein the said air supply distribution means comprises a control valve having an inlet to which pressurized air is supplied and a plurality of outlets which are connected to said plurality of groups of the said nozzles and wherein the said valve is such as to supply air in turn and cyclicly to the said outlets.

15. A machine according to claim 14, wherein the control valve is such as to cause the supplying of air to the next outlet in the cycle to be supplied with air to be commenced before termination of the supplying of air to the outlet being supplied with air.

16. A machine according to claim 1, wherein said rows each contain a plurality of said nozzles.

* * * * *